US005605117A

United States Patent [19]

Moskal

[11] Patent Number: 5,605,117

[45] Date of Patent: Feb. 25, 1997

[54] ARTICULATING SOOTBLOWER

[75] Inventor: Thomas E. Moskal, Pickerington, Ohio

[73] Assignee: The Babcock & Wilcox Company, New Orleans, La.

[21] Appl. No.: 342,868

[22] Filed: Nov. 21, 1994

[51] Int. Cl.[6] ..... F22B 37/18

[52] U.S. Cl. ..... 122/379; 122/391; 122/392; 165/95

[58] Field of Search ..... 122/379, 391, 122/392; 165/95

[56] References Cited

U.S. PATENT DOCUMENTS

| | | |
|---|---|---|
| 914,940 | 3/1909 | Flynn . |
| 1,010,028 | 11/1911 | Davies . |
| 1,060,800 | 5/1913 | Waller . |
| 1,441,431 | 1/1923 | Kirgan . |
| 1,780,435 | 11/1930 | Miller . |
| 1,874,452 | 8/1932 | Cole . |
| 2,089,710 | 12/1936 | Reekie . |
| 2,532,447 | 12/1950 | Handoll et al. . |
| 3,736,909 | 6/1973 | Marangoni et al. . |
| 4,437,201 | 3/1984 | Zalewski . |
| 4,498,213 | 2/1985 | Zalewski . |
| 4,580,310 | 4/1986 | Zalewski . |
| 4,583,496 | 4/1986 | Albers et al. . |
| 4,827,953 | 5/1989 | Lee . |
| 4,924,817 | 5/1990 | Seelen . |
| 4,980,120 | 12/1990 | Bowman et al. . |
| 5,040,262 | 8/1991 | Albers et al. . |
| 5,097,564 | 3/1992 | Billings . |
| 5,129,455 | 7/1992 | Boisture . |
| 5,277,153 | 1/1994 | Kakabaker . |
| 5,341,406 | 8/1994 | Jens et al. . |
| 5,411,043 | 5/1995 | Kamler . |

*Primary Examiner*—Henry A. Bennett
*Assistant Examiner*—Siddharth Ohri
*Attorney, Agent, or Firm*—Harness, Dickey & Pierce, PLC

[57] ABSTRACT

A sootblower for cleaning heat exchanger surfaces in a boiler. The sootblower includes a carriage assembly supported by a frame and adapted to cause translational and rotational movement of a lance tube to insert and retract the lance tube into and out of the boiler. The lance tube includes nozzles which project a blowing medium against the heat exchanger surfaces in the boiler. A mechanism is provided to articulate the sootblower so that the angular orientation of the lance tube can be altered with respect to the heat exchanger surfaces in the boiler. The articulating mechanism permits the carriage assembly to advance and withdraw the lance tube in and out of the boiler along a different axes thereby enabling greater cleaning coverage of the heat exchanger surfaces.

19 Claims, 3 Drawing Sheets

ARTICULATING SOOTBLOWER

BACKGROUND AND SUMMARY OF THE INVENTION

This invention generally relates to boiler cleaning. More specifically, the invention relates to a retracting sootblower having a mechanism for articulating the sootblower and lance tube so that the lance tube can be inserted over multiple insertion axes through a single access port in a boiler.

Sootblowers are used to project a stream of blowing medium, such as water, air, or steam, against the heat transfer surfaces of the tube bank located within the boiler. The blowing medium is used to dislodge various combustion byproducts, including slag and ash, which become deposited on the heat transfer surfaces. If the encrustations are not removed, boiler efficiency significantly decreases. By using the blowing medium to dislodge the encrustations, the thermal and mechanical shock provided by the medium fractures the encrustations, breaking them free, and dislodges them from the heat transfer surfaces. Through effective and consistent sootblowing, the efficiency of the boiler can be maintained.

One particular category of sootblower is the retractable sootblower. A retractable sootblower is located outside of the boiler and its lance tube is periodically advanced into and withdrawn from the boiler to perform cleaning. One or more nozzles are located on the end of the lance tube and project jets of the blowing medium. While being inserted and retracted, the lance tube is rotated so that the jets trace helical paths across the heat transfer surfaces.

Current retractable sootblowers insert and withdraw the lance tube over a generally straight, horizontal line of travel. The nozzles installed on the end of the lance tube therefore define a cylindrical area within the boiler tube where effective cleaning will be performed. Invariably, some areas of the boiler tube bank are less than adequately cleaned or not cleaned at all because of the lance tube's fixed line of travel. Additionally, a large number of sootblowers are needed to adequately clean the tube bank.

For example, in a best case situation, an array of sootblowers is installed so that the area cleaned by one sootblower slightly overlaps the area cleaned by an adjacent sootblower. More specifically, when sootblowers are installed in a rectangular array (one sootblower located in each corner of the rectangle), a diamond shaped area in the center of the rectangle receives poor cleaning coverage. More commonly, the cleaned areas of adjacent sootblowers do not overlap and an even more substantial area of the boiler tubes is inadequately cleaned.

Previously, sootblowers have been proposed where the entire frame of the sootblower is vertically and horizontally moved so that the sootblower can be inserted through different access ports in the boiler wall to effect cleaning in different areas of the tube bank with a single sootblower. Additionally, sootblowers have been constructed where the lance tube itself is flexible and a steering member is incorporated so as to redirect the lance tube after being inserted a certain distance in the tube bank.

Another cleaning device is a flue blower. These devices are designed so that their lance is pointed within a flue and then turned on to effectuate cleaning within the flue. Some flue blowers can be manipulated to point at multiple flues. These systems are manual systems which require the operator to position the lance tube at the desired location, turn on the blowing medium, and, in limited circumstances, rotate the lance. They are not intended to be inserted or retracted during cleaning.

Lacking in the prior art is a retractable sootblower which is capable of pivoting about an axis so that the lance tube can be inserted and retracted along multiple axes, inclinations or orientations while being repeatably inserted and withdrawn through the same access port in the boiler wall.

With these limitations in mind, it is an object of the present invention to provide a retractable sootblower adapted to pivot so that the lance tube can be inserted and retracted along multiple insertion axes thereby providing enhanced cleaning of the boiler tube banks.

Another object of this invention is to provide a sootblower system where the lance tube can be inserted through a single access port, but over different insertion axes.

It is also an object of this invention to provide a sootblower which is capable of being inserted and retracted along different axes on successive operating cycles of the system.

A further object of this invention is to provide a sootblower system where the lance tube can be inserted and the axis of insertion changed in the midst of the cleaning cycle.

Another object of the present invention is to provide a piping connection which allows the retractable sootblower to pivot while still utilizing rigid steam piping for supplying the blowing medium.

In achieving the above and other objects, the present invention provides a retractable sootblower which is articulable so that the lance tube can be inserted into and retracted from within a boiler over multiple insertion axes, but through a single or common access port. The sootblower according to the present invention includes an exteriorly located frame mounted adjacent to a wall box or access port in the boiler wall. A carriage assembly is supported by the frame and coupled to a lance tube which has at least one nozzle at its distal end. The lance tube generally defines the axis along which it will be inserted into and withdrawn from the interior of the boiler. As the lance is inserted, retracted or both, it is also rotated by the carriage assembly. A blowing medium is discharged through the nozzles of the lance so that the blowing medium traces a helical path as it is discharged. Since the blowing medium is ejected under significant pressure and at a cooler temperature than the boiler interior, the mechanical and thermal shock imparted by the jets causes the encrustations to fracture and dislodge from the heat exchanger surfaces.

If the lance tube can only be inserted along a single axis because it is fixed in position relative to the boiler, inevitably some portions of the heat exchanger surfaces will not receive adequate cleaning or will fail to be cleaned at all. This problem is alleviated by the present invention through the incorporation of a mechanism which causes the sootblower tube to pivot about a horizontal axis located generally adjacent to the boiler wall and the access port. Having this adjustability, the lance tube can be inserted along multiple axes, substantially increasing the cleaning coverage achievable with each sootblower.

Another advantage of the present invention is that while a substantial increase in the cleaning coverage is achieved, little change is actually needed to the design of the sootblower itself including the sootblower frame, carriage, feed tube and lance tube. The present invention therefore has the ability to be easily incorporated in retrofit applications. By incorporating the present invention in a boiler installation, a lesser number of sootblowers will be needed per boiler application. Obviously, significant cost benefits can be gained by reducing the actual required number of sootblowers. In all likelihood, this cost reduction will more than offset the cost of a single articulating sootblower according to this invention.

A portion of the mechanism which enables this articulation causes the outboard end of the sootblower frame to be raised or lowered depending on the desired lance tube orientation. The inboard end of the frame is mounted for rotation about a horizontal pivot axis. In one particular embodiment, a hydraulic actuator is manipulated by a controller to raise or lower the outboard end of the sootblower frame. Once the sootblower frame has been repositioned at the desired angular orientation, movement of the sootblower carriage assembly can be commenced.

Another feature of the present invention is a pivotable steam piping connection. Since the blowing medium is provided at high pressures, rigid piping remains necessary. In the disclosed embodiment of the piping connection, a supply tube is attached to the front end of the sootblower frame coincident with the pivot axis of the sootblower. The supply tube is connected to a feeder pipe which extends from the pivot, rearward along the frame toward the outboard end of the sootblower. The coupling permits rotary motion to occur between the supply pipe and the feeder pipe. At the outboard end, the feeder pipe is connected to the popper valve in a conventional manner.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
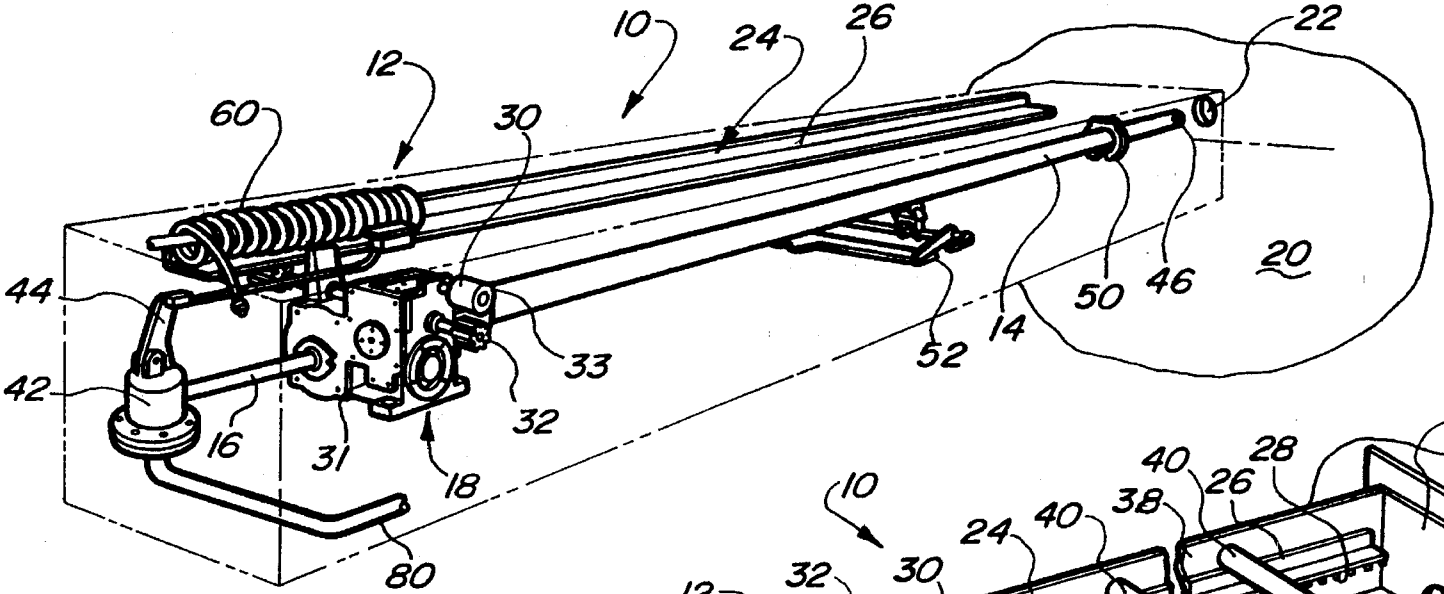
FIG. 1 is a perspective view of a retractable sootblower according to the principles of the present invention with the sootblower frame illustrated in phantom.

Referring now to the drawings, FIG. 1 illustrates a sootblower, generally designated at 10, embodying the teachings of the present invention. The sootblower 10 principally comprises a frame 12, a lance tube 14, a feed tube 16, and a carriage assembly 18.

The sootblower 10, shown in its retracted horizontal position, is located adjacent to a boiler wall 20 so that the lance tube 14 is aligned with a wallbox or access port 22. This port 22 permits the lance tube 14 to enter into the boiler to perform cleaning of the heat exchanger surfaces located within. Upon actuation, the carriage assembly 18 will cause translational movement of the lance tube 14 extending it into and then retracting it from the boiler.

The carriage assembly 18 is capable of causing translational movement of the lance tube 14 because it includes a transmission and drive system located within the carriage housing 31. The transmission and drive system move the carriage assembly 18 along a pair of rack assemblies 24 located on opposite, interior sides of the frame 12. The rack assemblies 24 are made up of sections of angle iron 26, welded or otherwise secured to the interior side wall of the frame 12, which support downwardly facing toothed racks 28. A pair of carriage rollers 30 are mounted to the carriage housing 31 so as to rest on top of the angle iron 26 and support the carriage assembly 18. Beneath the carriage rollers 30 are pinion gears 32 which engage the toothed racks 28. The pinion gears 32 are coupled through the transmission (not shown and located within the housing 31) to a motor 33 which is in turn is connected to a programmable controller 35 that will initiate a cleaning cycle as needed and according to the operational characteristics of the boiler itself. The transmission not only causes translational movement of the lance tube 14, but it also simultaneously causes rotational movement of the lance tube 14 as well.

Figure 2:
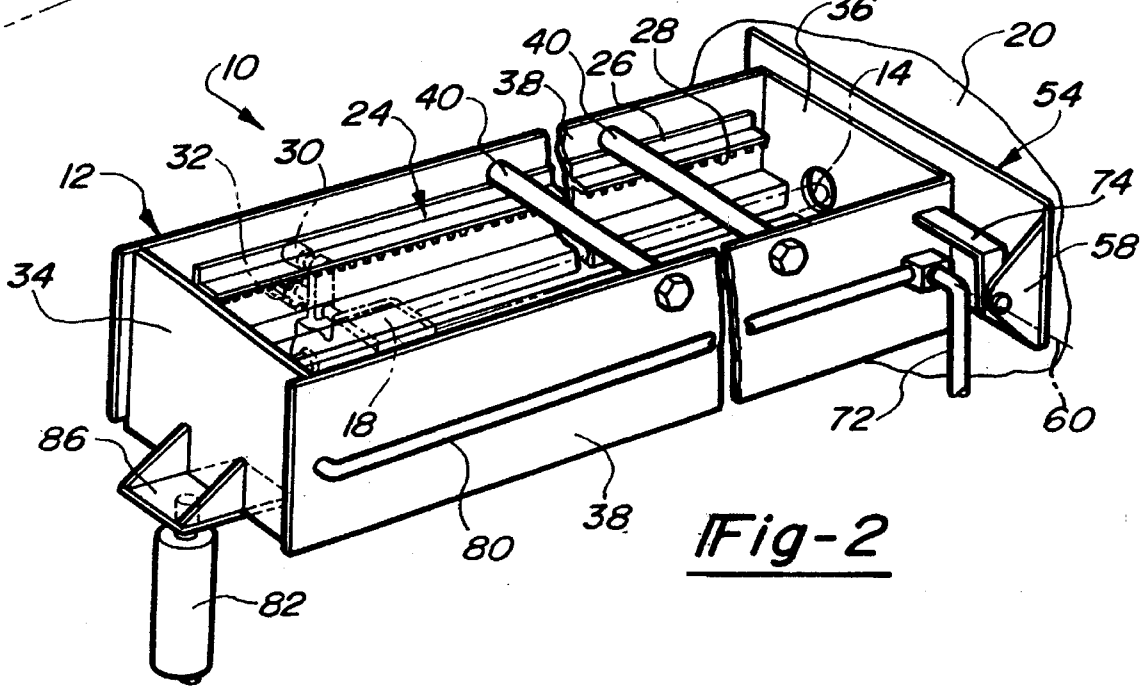
FIG. 2 is a perspective view of a sootblower according to the principles of the present invention with the carriage and lance tube shown in phantom.

As seen in FIG. 2, the frame 12 of the sootblower 10 includes an outboard end wall 34, an inboard end wall 36 and a pair of opposed side walls 38, to which the rack assemblies 24 are mounted as described above. At various positions along its length, the frame 12 may be provided with trusses, struts or other supports 40 that extend between the side walls 38. The struts 40 may be welded into position or bolted as shown. Additionally, the top of the frame 12 may be covered with panels (not shown) to enclose and protect both the carriage assembly 18 and the lance tube14. While only one variety of sootblower frame 12 is shown in the figures, it should be well understood that the present invention is equally applicable to alternative frame designs. For this reason, the present invention should not be interpreted as being strictly limited to the illustrated frame design, but should be read as having broad applicability to the full spectrum of sootblower frame designs.

The feed tube 16 is coupled at the rear end of the sootblower 10 to a poppet valve 42 which is typically mounted to a support bracket (not shown) which is secured to the outboard end wall 34 of the frame 12. The feed tube 16 conducts a blowing medium whose flow is controlled through the action of the poppet valve 42. Linkages 44 actuate the poppet valve 42 and are triggered by the carriage assembly 18 as it begins to move forward and insert the lance tube 14 into the boiler. Upon retraction of the lance tube 14 and rearward movement of the carriage assembly 18, the carriage assembly 18 again triggers the linkage 44 to shut off the flow of blowing medium. The lance tube 14 over fits the feed tube 16 and a packing gland (not shown) creates a fluid seal between them. In this manner, the blowing medium is conducted from the feed tube 16 into the lance tube 14 for discharge from nozzles 46 located on the end of the lance tube 14.

A coiled electric cable 60 provides power to the drive motor 33 as the motor 33 moves with the carriage assembly 18 during insertion and retraction. A front support 50 includes bearings which support the lance tube 14 during its longitudinal and rotation movements. For longer lance tube 14 lengths, an intermediate support 52 may be provided to prevent excessive bending or deflection of the lance tube 14.

Additional details of the construction of a well known design of an "IK" type sootblower is found in U.S. Pat. No. 3,439,376, issued and assigned to the assignee of the present invention.

Figure 3:
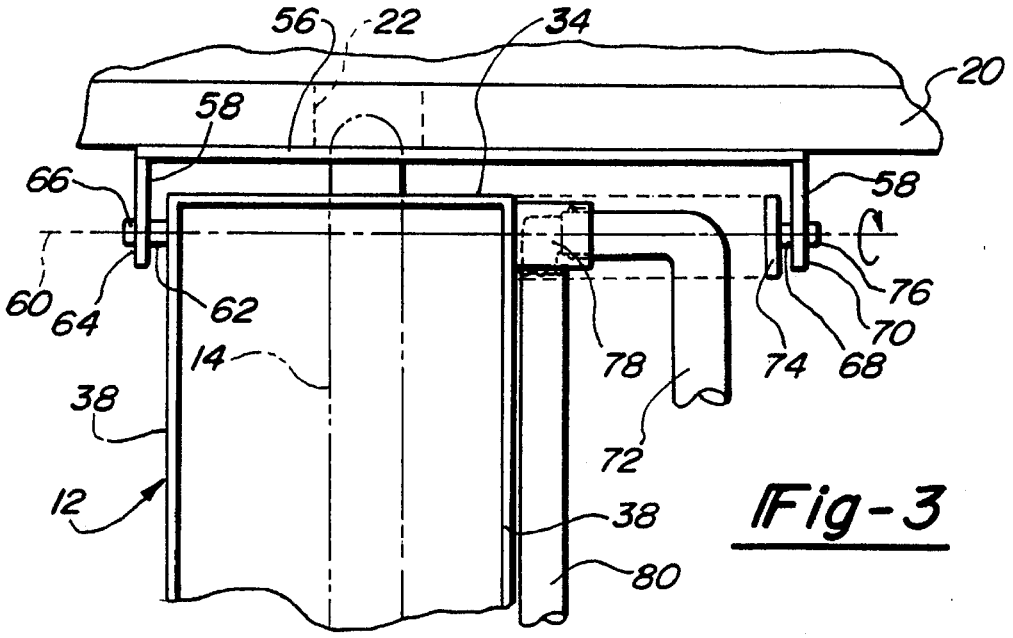
FIG. 3 is a top plan view of the pivotable mounting and piping connection utilized with the present invention.

As mentioned above, the frame 12 is mounted so that the lance tube 14 can be inserted through an access port 22 into the interior of the boiler. The mechanism by which the frame 12 is mounted to the boiler wall 20 is illustrated in FIGS. 2 and 3. The mechanism includes a mounting bracket 54 which itself is made up of a wall plate 56 and a pair of opposed support plates 58. The wall plate 56 is mounted parallel to the boiler wall 20 and the support plates 58 extend outward from the wall plate 56. The wall plate 56 has an aperture (not shown) defined in it which corresponds in position with the access port 22 in the boiler wall 20. The wall plate 56 can be secured to the boiler wall through any conventional means including bolting it or welding it directly to the wall 20 or to another bracket attached to the wall 20.

The support plates 58 are connected to the sootblower frame 12 and the connection between them is one which defines a generally horizontal pivot axis 60 which allows for rotation or pivoting of the sootblower frame 12 relative to the boiler wall 20. As seen in FIG. 3, on the left side of the frame 12 a pivot axle 62 extends laterally from the frame's left side wall 38 into an aperture 64 defined in the support plate 58. The axle 62 is retained by a threaded nut, cap or other retaining device 66, such as a pin inserted through the axle 62. On the right side of the frame 12, it can be seen that another pivot axle 68 is also extended into an aperture 70 defined in the support plate 58 and is retained by a cap or other retaining device 66. The two axles 62 and 68 are coaxial with one another and cooperate to define the pivot axis 60.

In order to accommodate a blowing medium supply pipe 72 as further described below, the axle 68 is mounted to an extension bracket 74 that is secured to the right side wall 38 and which laterally spaces the axle 68 from the right side wall 38 of the frame 12. When mounted in this manner, the frame 12 is capable of pivoting about the pivot axis 60 to alter the axis along which the lance tube 14 is inserted during a cleaning cycle.

As mentioned earlier, rigid piping is preferably used with sootblowers because of the high pressures at which the blowing medium is provided. Since the sootblower 10 of the present invention pivots about an axis, accommodations must be made for the rigid piping.

In accommodating pivoting of the frame 12 relative to the boiler wall 20, the blowing medium supply pipe 72 is connected to a feed pipe 80 through a rotary coupling 78. The feed pipe 80 extends rearward along the exterior of the right side wall 38 of the frame 12 before passing through an aperture, defined in the side wall, and connecting to the poppet valve 42 mentioned above. As is evident from FIGS. 3 and 4, the rotary coupling 78 enables the feed pipe 80 to rotate relative to the supply pipe 72. Obviously the rotary coupling 78 includes a packing gland and other features which permit the relative rotary movement while preventing leakage of the blowing medium. Since additional features will depend on the specific design considerations of the sootblower system, they are not being described herein in greater detail.

Figure 4:
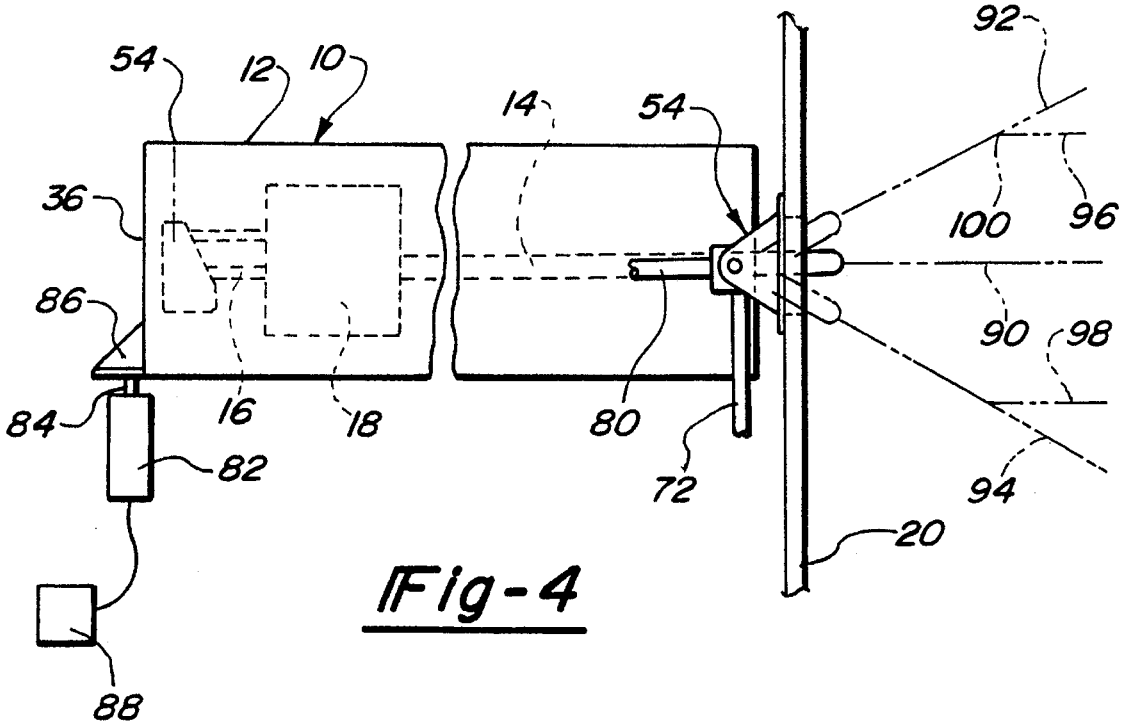
FIG. 4 is a side view illustrating a sootblower embodying the teachings of the present invention and further showing the multiple insertion axes along which the lance tube can be inserted.

The ram 84 of a hydraulic actuator 82 is used to raise or lower the outboard end of the sootblower frame 12 and pivot the frame 12 at its inboard end about the pivot axis 60. As seen in FIG. 4, this causes the inclination of the insertion axis, as defined by the lance tube 14, to be varied. The actuator 82, which could alternatively be a pneumatic actuator or a gear driven mechanical actuator, engages the outboard end of the frame 12. Numerous different constructions could also be used to mount the ram 84 of the actuator 82 to the outboard end of the frame 12. The illustrated construction uses a support bracket 86 which is secured to the outboard end wall 36. The ram 84 of the actuator 82 is bolted or otherwise secured to this support bracket 86 which can be the same controller which causes movement of the carriage assembly 18.

The actuator 82 itself is connected to the controller 35 which causes movement of the carriage assembly 18 and, according to a schedule based on the operating characteristics of the boiler, causes the actuator 82 to vary the inclination of the lance tube 14 so that optimum cleaning will be achieved. When the sootblower 10 is in a generally horizontal position, the lance tube 1 will be inserted and retracted by the carriage 18 along a horizontal axis generally designated at 90. In order to clean heat exchanger surfaces located above those areas cleaned as the lance 14 is moved along axis 90, the actuator 82 lowers the outboard end of the sootblower 10 and inserts the lance tube 14 along the inclined axis designated at 92. When inclined, the area being cleaned is in the insufficiently cleaned "diamond" area shown in FIG. 6. Similarly, in order to clean areas of the heat exchanger surfaces beneath those cleaned during insertion and retraction of the lance tube 14 along axis 90, the controller 88 causes the actuator 82 to raise the outboard end of the sootblower 10 thereby permitting the lance tube to be inserted along the declined axis designated at 94. Obviously, the lance tube 14 can be inserted along any axis between the inclined axis 92 and the declined axis 94 by lowering or raising the outboard end of the sootblower frame 12 to a lesser degree.

It is also possible for the insertion and retraction axis of the lance tube 14 to be varied during the course of a cleaning cycle. For example, the controller 35 could begin inserting the lance tube 14 along the inclined axis 92 until reaching the point designated at 100. Afterwards, as the lance tube 14 is inserted, the actuator 82 would slowly raise the outboard end of the frame 12 thereby causing the nozzles on the lance tube 14 to be inserted along a generally horizontal axis, designated at 96, which is located a distance above and parallel with the previously mentioned horizontal axis 90. Similarly, it is also possible to insert the lance tube 14 and cause it to follow a generally horizonal path 98 located between horizontal axis 90 and the declined axis 94. This is achieved by starting with the outboard end of the frame 12 raised and then slowly lowering the outboard end of the frame 12 during insertion of the lance tube 14.

In the above manner, a single sootblower 10 can be used to effectively clean an increased area of heat exchanger surfaces. This area extends well above and below a horizontal axis defined through the axis port 22.

Figure 5:
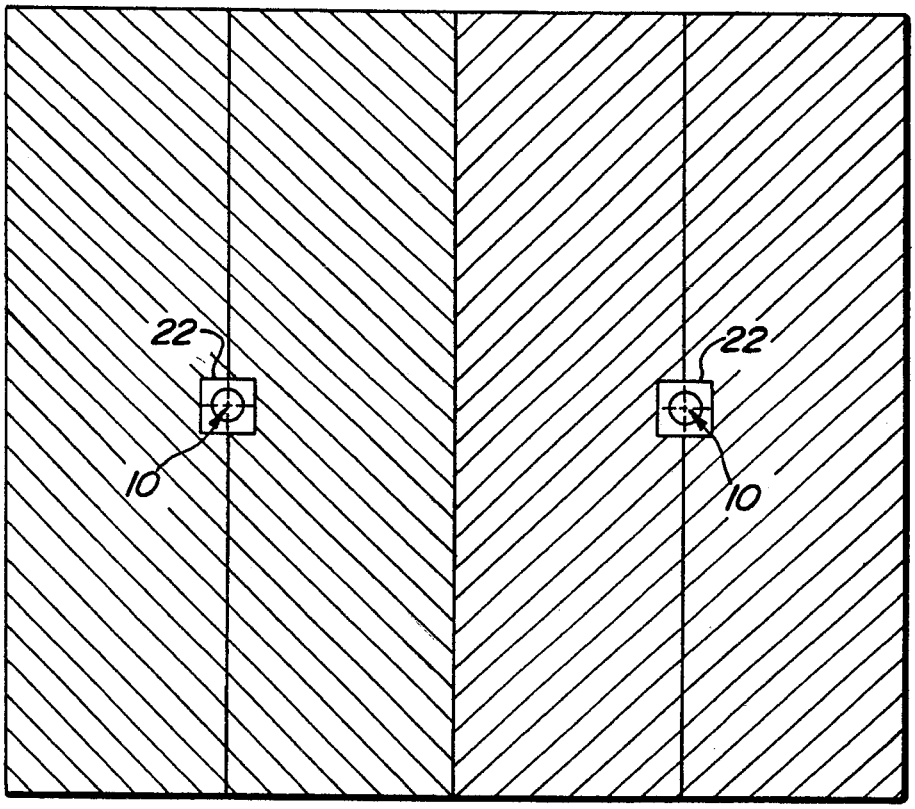
FIG. 5 is a schematic illustration generally showing the cleaning coverage provided by the articulating sootblower of the present invention.
Figure 6:
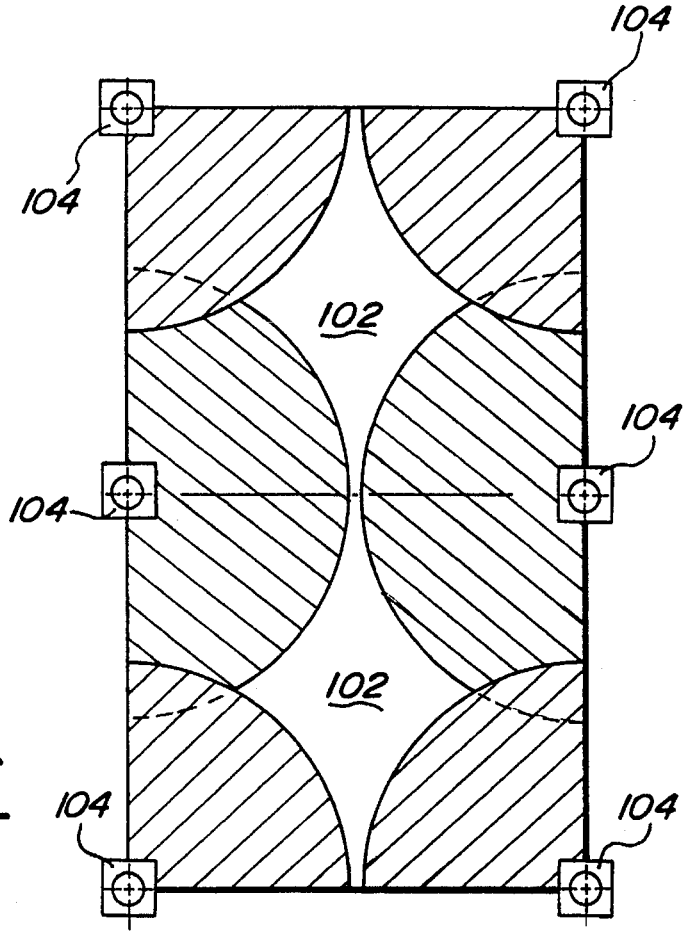
FIG. 6 is schematic view generally showing the cleaning coverage generally provided by prior retractable sootblower designs.

The cleaning coverage or pattern provided by prior sootblowers is generally seen in FIG. 6 where it has been simplified to be a single distance when rotated about the lance tube axis. The cleaning coverage provided by a sootblower 10 according to the present invention is schematically seen in FIG. 5. In these figures, the cleaning pattern for each respective sootblower array and is taken through the boiler heat transfer surfaces along a plane which is parallel to the boiler wall.

In FIG. 6, two vertically aligned rows, of three fixed position sootblowers each, are generally represented with the horizontal lance axes being designated at 104. This fixed positioning of sootblower lance axes 104 result in the production of diamond shaped areas 102 which represent areas of ineffective cleaning. In FIG. 5, each vertical row of sootblowers has been replaced with a single sootblower 10 which, according to the present invention, exhibits a lance axis 90 that can be varied away from horizontal. By inclining and declining the lance axis 90 the diamond shaped areas 102 of FIG. 6 can be eliminated thereby providing more effective cleaning with a lesser number of sootblowers.

While the above description constitutes the preferred embodiment of the present invention, it will be appreciated that the invention is susceptible to modification, variation and change without departing from the proper scope and fair meaning of the accompanying claims.

I claim:

1. An articulating, retractable sootblower for cleaning heat exchanger surfaces within a large scale combustion device including a wall having an access port defined therein, said sootblower comprising:

a frame located exteriorly of the device;

a lance tube defining a lance axis and having at least one nozzle for projecting a blowing medium therethrough, said nozzle directing the blowing medium against the heat exchanger surfaces;

supply means for supplying the blowing medium to the lance tube for discharge therefrom;

a carriage assembly supported by said frame, said carriage assembly being coupled to said lance tube and including a translational drive means for causing translational movement of said carriage assembly and said lance tube along said frame resulting in insertion and retraction of said lance tube into and out of the combustion device, said carriage assembly also including drive means for causing rotational movement of said lance tube about said lance axis; and articulating means for articulation of said lance tube to vary the angular orientation of said lance tube with respect to the heat exchanger surfaces, said articulating means enabling said carriage assembly to cause said lance tube to be advanced into and withdrawn from the interior of the combustion device along a plurality of differently oriented axes as the blowing medium is discharged resulting in an increased area of cleaning coverage.

2. A sootblower as set forth in claim 1 wherein said articulating means pivots said lance tube along a substantially vertical plane.

3. A sootblower as set forth in claim 1 wherein said articulating means pivots said lance tube in a generally vertical direction and about a substantially horizontal pivot axis located adjacent one end of said frame.

4. An articulating, retractable sootblower for cleaning heat exchanger surfaces within a large scale combustion device including a wall having an access port defined therein, said sootblower comprising:

a frame located exteriorly of the device;

a lance tube defining a lance axis and having at least one nozzle for projecting a blowing medium therethrough, said nozzle directing the blowing medium against the heat exchanger surfaces;

supply means for supplying the blowing medium to the lance tube for discharge therefrom;

a carriage assembly supported by said frame, said carriage assembly being coupled to said lance tube and including a translational drive means for causing translational movement of said carriage assembly and said lance tube along said frame resulting in insertion and retraction of said lance tube into and out of the combustion device, said carriage assembly also including drive means for causing rotational movement of said lance tube about said lance axis; and articulating means for articulation of said lance tube to vary the angular orientation of said lance tube with respect to the heat exchanger surfaces, said articulating means enabling said carriage assembly to cause said lance tube to be advanced into and withdrawn from the interior of the combustion device along a plurality of differently oriented axes as the blowing medium is discharged resulting in an increased area of cleaning coverage, said articulating means pivoting said lance tube in a generally vertical direction and about a substantially horizontal pivot axis located toward an inboard end of said frame and adjacent to said wall.

5. A sootblower as set forth in claim 1 wherein said articulating means includes an actuator which raises and lowers one end of said frame.

6. A sootblower as set forth in claim 5 wherein said actuator is a hydraulic actuator.

7. A sootblower as set forth in claim 5 wherein said actuator is a pneumatic actuator.

8. A sootblower as set forth in claim 5 wherein said actuator is a mechanical actuator.

9. A sootblower as set forth in claim 1 further comprising control means for controlling said articulating means and varying the angular orientation of said lance tube between successive operating cycles of said sootblower.

10. A sootblower as set forth in claim 1 further comprising control means for controlling said articulating means and varying the angular orientation of said lance tube over the course of an operating cycle.

11. An Articulating, retractable sootblower for cleaning heat exchanger surfaces within a large scale combustion device including a wall having an access port defined therein, said sootblower comprising:

a frame located exteriorly of the device;

a lance tube defining a lance axis and having at least one nozzle for projecting a blowing medium therethrough, said nozzle directing the blowing medium against the heat exchanger surfaces;

supply means for supplying the blowing medium to the lance tube for discharge therefrom, said supply means including a first rigid pipe, a second rigid pipe and a coupling permitting relative movement therebetween;

a carriage assembly supported by said frame, said carriage assembly being coupled to said lance tube and including a translational drive means for causing translational movement of said carriage assembly and said lance tube along said frame resulting in insertion and retraction of said lance tube into and out of the combustion device, said carriage assembly also including drive means for causing rotational movement of said lance tube about said lance axis; and articulating means for articulation of said lance tube to vary the angular orientation of said lance tube with respect to the heat exchanger surfaces, said articulating means enabling said carriage assembly to cause said lance tube to be advanced into and withdrawn from the interior of the combustion device along a plurality of differently oriented axes as the blowing medium is discharged resulting in an increased area of cleaning coverage.

12. A sootblower as set forth in claim 11 wherein said coupling permits relative rotary movement between said first and second rigid piping.

13. A sootblower as set forth in claim 12 wherein said coupling is located generally adjacent to said boiler wall at an inboard end of said frame.

14. A sootblower as set forth in claim 12 wherein said coupling is coincident with said pivot axis.

15. A sootblower as set forth in claim 11 wherein said first and second rigid piping are oriented transversely with respect to one another.

16. A sootblower as set forth in claim 1 wherein said frame is mounted to the boiler wall for pivotal movement with respect thereto.

17. A method of operating a sootblower to clean heat exchanger surfaces within a combustion device with a blowing medium, the method comprising the steps of:

providing a sootblower having a lance tube capable of being inserted into and retracted from the interior of the combustion device;

inserting the lance tube of the sootblower through an access port in a wall of the boiler, said lance tube being inserted at a first orientation with respect to the heat exchanger surfaces;

discharging the blowing medium from the lance tube and against the heat exchanger surfaces while said lance tube is in said first orientation;

retracting the lance tube from within the combustion device after insertion at said first orientation;

inserting the lance tube of the sootblower through the same access port in the wall of the combustion device, said lance tube being inserted at a second orientation with respect to the heat exchanger surfaces;

discharging the blowing medium from the lance tube and against the heat exchange surfaces while said lance tube is in said second orientation; and retracting the lance tube from within the combustion device after insertion at said second orientation.

18. The method of claim 17 further comprising the step of varying the orientation of said lance tube with respect to the heat exchanger surfaces between successive operating cycles and insertions into the combustion device.

19. The method of claim 17 further comprising the step of varying the orientation of said lance tube with respect to the heat exchanger surfaces during the course of at least one insertion and retraction of said lance tube.

* * * * *